United States Patent [19]

Ward et al.

[11] Patent Number: 4,691,773

[45] Date of Patent: Sep. 8, 1987

[54] INSITU WET COMBUSTION PROCESS FOR RECOVERY OF HEAVY OILS

[75] Inventors: George D. Ward, Washington; Charles E. Ward, West Redding, both of Conn.

[73] Assignee: Ward Douglas & Co. Inc., Washington Depot, Conn.

[21] Appl. No.: 759,359

[22] Filed: Jul. 26, 1985

Related U.S. Application Data

[63] Continuation-in-part of Ser. No. 657,723, Oct. 4, 1984, abandoned.

[51] Int. Cl.[4] ..... E21B 43/24; E21B 43/243

[52] U.S. Cl. ..... 166/261; 166/272

[58] Field of Search ..... 166/261, 272, 372

[56] References Cited

U.S. PATENT DOCUMENTS

| | | | |
|---|---|---|---|
| 2,061,865 | 11/1936 | Wells | 166/372 X |
| 2,293,196 | 8/1942 | Crump | 166/372 X |
| 3,149,670 | 9/1964 | Grant | 166/261 X |
| 3,342,257 | 9/1967 | Jacobs et al. | 166/247 |
| 3,366,176 | 1/1968 | Parrish | 166/261 X |
| 3,905,553 | 9/1975 | Bradley et al. | 166/261 X |
| 3,987,851 | 10/1976 | Tham | 166/272 X |
| 3,994,343 | 11/1976 | Cha et al. | 166/261 X |
| 4,036,299 | 7/1977 | Cha et al. | 166/261 |
| 4,089,375 | 5/1978 | Cha | 166/261 |
| 4,192,381 | 3/1980 | Cha | 166/261 |
| 4,252,191 | 2/1981 | Pusch et al. | 166/261 |
| 4,454,915 | 6/1984 | York et al. | 166/261 X |
| 4,493,369 | 1/1985 | Odeh et al. | 166/261 |
| 4,557,329 | 12/1985 | Savard et al. | 166/261 |

*Primary Examiner*—George A. Suchfield

[57] ABSTRACT

An insitu wet combustion process for the recovery of heavy oils from subterranean oil formations, such as tar sands, in which non-oxygen containing fluid, such as water, is introduced along with air cyclically to produce periodic high volume rates of injected fluid, great enough to increase the total sensible heat carrying capacities of the air and the vaporized fluid, such as steam, entering the flame zone substantially above the sensible heat capacity of the rock formation entering the flame zone, to substantially increase the temperatures of a downstream hot zone downstream of the flame front, without quenching the combustion.

12 Claims, 1 Drawing Figure

INSITU WET COMBUSTION PROCESS FOR RECOVERY OF HEAVY OILS

CROSS-REFERENCE TO RELATED APPLICATION

This is a continuation-in-part of application Ser. No. 657,723, filed, Oct. 4, 1984, now abandoned.

BACKGROUND OF THE INVENTION

This invention relates to the insitu combustion process of the recovery of heavy oils, and more particularly to an improved insitu wet combustion process.

Various methods of insitu combustion of underground oil formations, such as tar sands, or oil shale, for extracting petroliferous products, and especially heavy oils, are well known in the art.

In the forward combustion process, an injection well is driven down through a subterranean oil formation, and one or more production wells are driven through the same oil formation at a predetermined distance or spacing from the injection well. Air is injected into the injection well, and the oil within the formation is ignited by any of various ignition devices or methods to commence the combustion of the oil. The combustion occurs in a very narrow zone to create a flame front, or combustion front, which is propagated through the reservoir rock or formation to gradually move toward the producing well, pushing in advance of the front oil, water and flue gases. Since the region immediately in advance of the flame front is warm, e.g., 200°-350° F., the oil becomes less viscous and flows with greater facility toward the producing well. There is a very limited zone in advance of the flame front where the temperature may rise, by virtue of heat transfer through conduction, to a level, usually 700°-800° F. or higher, where some cracking and viscosity reduction occurs. However, in the conventional forward combustion process, such cracking is limited.

In the conventional reverse combustion process, the oil is ignited at the production well and the flame is propagated in the reverse direction from a forward combustion process. Air is still injected at the injection well to drive the oil through the flame front commenced at the production well. This process is effective in reducing the viscosity of the oil substantially in the region around the production well. However, the air requirements for the reverse combustion recovery process are generally greater than the air requirements for the forward combustion process. Moreover, maintaining a stable reverse propagation of the flame front is often very difficult in field operations.

In the conventional wet combustion process, the forward combustion process is modified by the introduction of water at the injection well. A part of all of the injected water will vaporize into steam as it passes through the hot zone upstream of the flame front. This stem is condensed back to water when it reaches the cold unheated reservoir downstream of the flame front. Thus the injection of water transfers heat from the zone upstream of the flame front to downstream of the flame front and heats more of the reservoir downstream of the flame front to the steam condensation temperature than would occur in dry combustion. Heating more of the reservoir to the steam condensation temperature (generally 250°-400° F.) results in reduction of the viscosity of more of the oil in the downstream section of the reservoir. This results not because of added cracking of the oil but because the viscosity of the oil is reduced as temperature is raised even if no cracking has occurred. In addition, the additional steam, in combination with the air, are both utilized to move the greater amounts of less viscous oil toward the producing well. Steam may be substituted for water in the wet combustion process, but water is usually more economical.

In the wet combustion process, it is possible to utilize a smaller air-oil ratio, as it has been found that the use of water with air will reduce the amount of fuel burned and increase the burn front velocity over that obtained without the use of water. Of course, care must be exercised in order not to use an excessive amount of water which might quench the combustion entirely.

However, in the conventional wet combustion process, and in the conventional dry forward combustion process, the cracking of heavy oils within the formation is still substantially limited to a small high-temperature area immediately downstream of the flame front. In the conventional wet combustion process, the effect of the generated steam propagated downstream of the flame front is only to substantially extend the area of the warm zone in advance of the flame front for reducing oil viscosity. Nevertheless, the temperature of the advance warm zone is still not high enough to crack the oil contained within the advanced warm zone.

Some examples of prior combustion processes are disclosed in the following publication and patents:

Secondary and Tertiary Oil Recovery Processes—Interstate Oil Compact Commission—1978, Second Printing—Chapter V Insitu Combustion;

U.S. Pat. No. 4,265,310, Britton et al., May 5, 1981;

U.S. Pat. No. 4,397,352, Audeh, Aug. 9, 1983.

SUMMARY OF THE INVENTION

It is therefore an object of this invention to provide an improved wet combustion process for the insitu recovery of heavy oils, including oil from tar sands or oil shale, in which the temperature of the rock formation downstream of the flame front is raised sufficiently to cause substantially more cracking of the oil, or kerogen in the case of oil shale, downstream of the front, without quenching the combustion behind the flame front, than occurs in the conventional wet combustion process.

Another object of this invention is to provide a process in which the uncombined molecular oxygen concentration of the injected gas reaching the frame zone is periodically reduced so that the heat carrying capacity of the fluids entering the flame zone exceeds the heat carrying capacity of the reservoir rock entering the flame zone at any instant of time.

In this invention, the insitu combustion operation is carried out in the following manner. In the following description of the process the concentration of free uncombined oxygen entering the flame zone is raised or lowered by the addition of greater or lesser amounts of water along with air. However, in this invention other techniques described later can be used to change this oxygen concentration. Stage 1 of the operation is carried out in the same manner as a conventional wet forward combustion process. Air with a relatively small amount of water is injected into the oil-bearing stratum via a central injection well which is surrounded by a group of producing wells at an appropriate spacing. Ignition is achieved by any of a variety of means well known in the art. A flame front zone is formed which advances through the oil-bearing rock formation towards the producing wells, with flue gases and steam displacing most of the oil towards the producing wells in advance of this flame front. The rate of advance of the flame front is a function of the rate injection of the free uncombined molecular oxygen in the injected air and the amount of undisplaced oil (which may be in the form of coke, at least in part) which remains in the pores of the reservoir rock as the rock relatively moves into the flame zone. Downstream of the flame front, a zone is formed which is approximately at the condensation temperature of the steam present (e.g. 250°-500° F.). The oil in this "steam zone" is more mobile than in the original reservoir due to its lower viscosity at this higher temperature. The zone immediately upstream of the flame front has been heated by the combustion operation to a more elevated temperature (e.g. 800°-1500° F.). Further upstream of the flame front nearer the injection well, the hot zone behind the flame front is quenched to the inlet air/water temperature in what is called a "cold front". In this cold front in inlet water is also vaporized by the hot reservoir rock generating steam. The nature of the heat balance in a conventional wet combustion operation is such that the velocity of the cold front is usually less than the velocity of the flame front so that this hot zone upstream of the flame front expands with time. However, if the water rate were to be increased sufficiently, the velocity of the cold front would increase and eventually the entire hot zone (800°-1500° F.) upstream of the flame front would be quenched down to the steam condensation temperature (typically 250°-500° F.) or lower. Such a condition is known as "quenched combustion", and would not normally be employed at this initial stage when operating in accordance with this invention.

In this Stage 1 of the operation, the heat carrying capacity of the air/steam mixture (measured, for example, in BTU's/hr per degree) entering the flame zone, which is directly a function of the rates at which air and water are being injected, normally is significantly less than the corresponding heat carrying capacity of the rock (similarly measured) entering the flame zone. The heat carrying capacity of the rock depends on the flame front velocity, which is a function of the amount of residual oil left within the rock and the rate of injection of free uncombined molecular oxygen, being independent of the water injection rate.

Also in Stage 1 of the operation there is some conduction of heat from the hot zone upstream of the flame front which results in some vertical and horizontal heat transfer creating a small zone downstream of the flame front and the steam zone. This small zone in some cases may be hot enough to cause some small amount of cracking and intrinsic viscosity reduction of oil downstream of the flame front. However, this amount of cracking is relatively minor.

Stage 1 of the operation is carried out long enough to create a substantially large hot zone upstream of the flame front. The length of time required varies greatly, depending on the reservoir characteristics and the air and water injection rates. Frequently, it may be in the range of 15 to 60 days.

Stage 2 of the operation is then commenced by increasing the water-to-air ratio markedly so that the heat carrying capacity of the air/steam mixture (again measured, for example, in BTU's per hr per degree) becomes significantly greater than the heat carrying capacity of the rock entering the flame zone. This result is possible since the heat carrying capacity of the air/steam mixture increases as the water injection rate is increased, while the heat carrying capacity of the rock remains the same because the flame front velocity is a function of the injection rate of free uncombined molecular oxygen in the air and not the water or steam rate entering the flame zone. Since, at this point in time, a hot zone exists upstream of the flame front, the air/steam mixture will enter the flame front zone at a temperature about equal to that of the hot zone (e.g. 800°-1500° F.). However, because now the heat carrying capacity of this stream is greater than that of the rock entering the flame zone, the rock no longer has the heat capacity to remove the heat of combustion and to cool the gas mixture down to the steam zone temperature, even if it were to be raised to a very high temperature. A new heat balance therefore is established in which the gases now leave the flame zone at a temperature higher than that at which they entered (e.g. 1000°-2000° F.), resulting in the removal of the heat of combustion from the flame front and any sensible heat from the rock. This very hot (e.g. 1000°-2000° F.) flue gas steam mixture leaving the flame zone quickly heats up the reservoir rock and oil immediately downstream of the flame front, forming a "downstream hot front" in which the temperature of the reservoir rock and oil is increased, essentially to this new high temperture. The "downstream hot front" advances towards the producing wells at a velocity greater than that of the flame front, and creates a "downstream hot zone" containing oil in which very substantial amounts of cracking and intrinsic viscosity reduction occur. It should be noted that viscosity reduction of oil can occur in two manners. First, simply raising the temperature of the reservoir will reduce the viscosity because viscosity of oil is lower at higher temperatures. This occurs in any thermal operation which raises the temperature of a reservoir. However, if the temperature is raised sufficiently so that cracking occurs further reduction of the "intrinsic" viscosity occurs. Cracking is a chemical reaction which splits the viscous larger molecules into less viscous shorter molecules. To obtain significant cracking of this type temperatures of about 700 or higher are usually required and the higher the temperature the greater the rate at which the cracking will occur. Significantly greater viscosity reduction of the oil can be caused by this cracking than will occur just by the increase in the temperature of the oil. In this patent application the term "intrinsic viscosity reduction" refers to viscosity reduction caused by the cracking of the oil contrasted to viscosity reduction which occurs as temperature increases.

If the above Stage 2 of the operation is continued long enough, the markedly increased quantities of water injected would eventually cool down the entire hot zone upstream of the flame front and the operation would become one with quenched combustion in which no "downstream hot zone" would exist. To avoid this usually undesirable result, in this invention the Stage 2 operation is stopped just before such quenching occurs, by reducing the water injection rate (or water-to-air ratio) to place the operation back into the initial Stage 1 mode until a significant hot zone behind the flame front is reestablished. Thereafter, the Stage 2 mode is resumed.

The operation is thus cycled between the Stage 1 mode and the Stage 2 mode until all the oil is produced, or until the desired amount of cracking and intrinsic viscosity reduction of the oil in the reservoir has been obtained. Thereafter, conventional recovery methods, such as steam or water injection without combustion in the subterranean formation, can be used for the remainder of the production operation, utilizing the benefit, of course, of the lower intrinsic viscosity oil achieved by use of this invention.

When the operation is cycled back to the Stage 1 mode from the Stage 2 mode, the zone immediately downstream of the flame front will revert to a temperature close to that of the steam zone (300°-500° F.), but the zone next further downstream will continue at the high temperature established in Stage 2 (moderated with time, of course, due to heat losses by conduction). Thus, when operating in the cyclic manner of this invention, a series of "downstream hot zones" are created which move through the reservoir towards the producing wells, and which are interspersed with zones at the normal steam zone temperature. With time, these "downstream hot zones" loose their higher temperature level to adjacent zones by conduction, but before this happens the creation of these "downstream hot zones" has caused the desired significant cracking and intrinsic viscosity reduction of the oil in the pores of the reservoir rock.

While the above description has been based on an operation in which a mixture of air and water are injected, alternative fluids may be used. For example oxygen or enriched air may be substituted for atmospheric air. Alternatively steam could be injected in lieu of water along with air, or other fluids could also be injected such as the combustion gases generated at the producing wells. A critical feature of the invention is to cyclicly adjust the composition of the combined fluids entering the flame zone so that the heat content, as previously defined, of the fluids entering the flame zone is first in Stage 1 less than the heat content of the reservoir rock entering the flame zone; then in the Stage 2 the heat content of the incoming fluids entering the flame zone is greater than the heat content of the reservoir rock entering the flame front. The heat content of the incoming reservoir rock entering the flame zone is directly proportional to the velocity of the flame front and therefore to the rate of injection of free uncombined molecular oxygen in the fluids entering the flamezone. For a given set of reservoir and fluid properties and given fuel content of the reservoir rock entering the flame zone there will be a critical concentration of free uncombined molecular oxygen at the flame zone. If the oxygen content is above this critical value the heat content of the entering fluids will be less than that of the entering reservoir rock and we will have a "stage one" type of operation. If the oxygen concentration drops below this critical value, due for addition of other components to the injected fluids, then the reverse will be true and the heat carrying capacity of the inlet fluids will be greater than that of the reservoir rock and we will have a "stage two" type of operation.

When the invention is applied to oil shale, the temperature in the downstream hot zone is sufficient to cause cracking of the kerogen, releasing it from the shale in the form of shale gas and shale oil.

DESCRIPTION OF THE PREFERRED EMBODIMENTS

Figure 1:
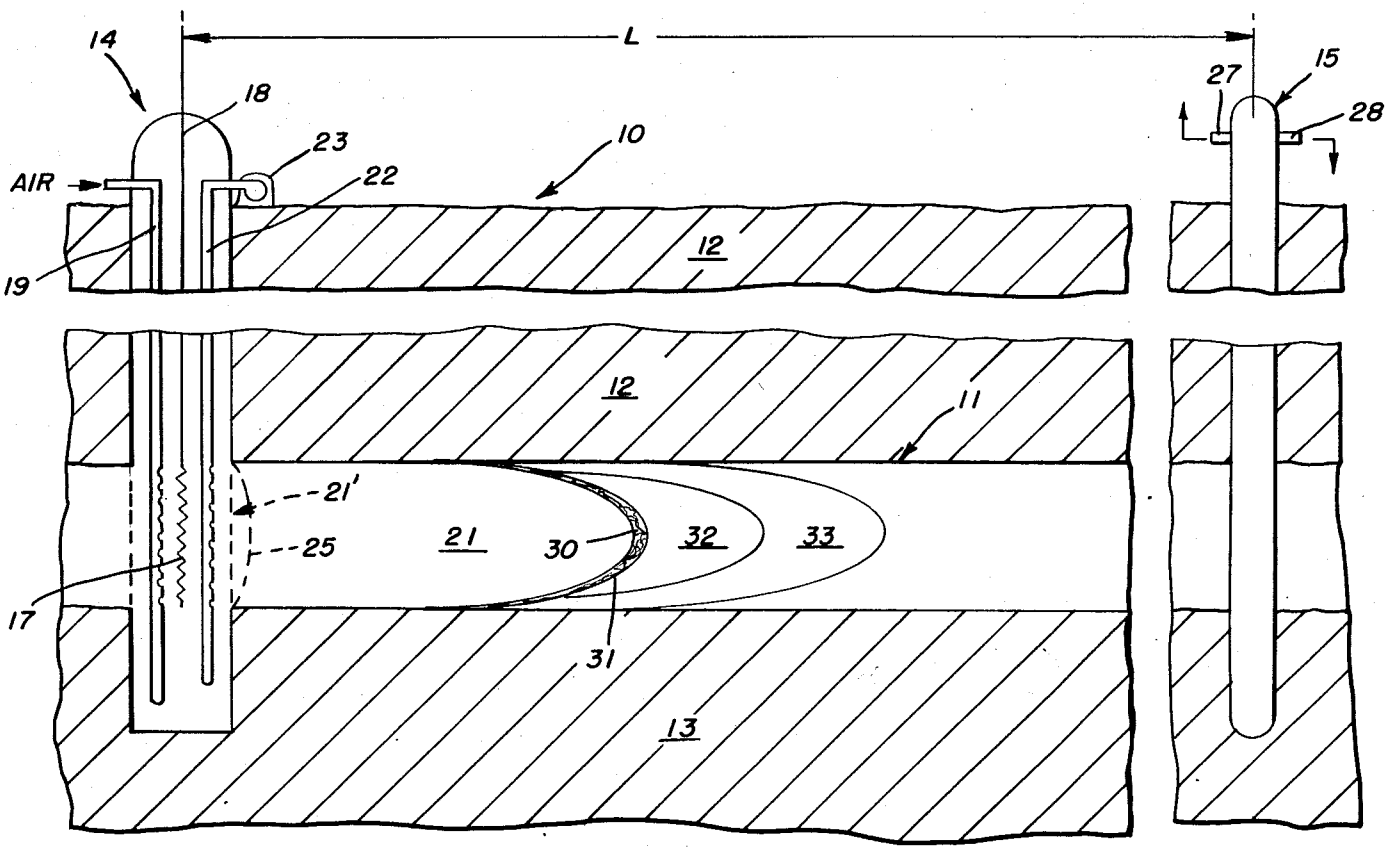
FIG. 1 is a schematic sectional elevation of an oil formation, illustrating the thermal recovery process of this invention.

Referring now to FIG. 1 in more detail, a cross-section of the terrain 10 is disclosed incorporating an oil reservoir or rock formation, such as a tar sand formation 11, covered by overburden 12 and resting upon stratum 13.

Longitudinally spaced from each other and penetrating the tar sand formation 11, is an injection well 14 and a production well 15. The distance between the injection well 14 and the production well 15 is indicated by the distance L.

The injection well 14 may include an ignitor, such as an electrical ignitor 17 controlled through electrical lead 18 from controls above the surface of the terrain 10, not shown.

Air is introduced into the injection well 14 through the pipe or conduit 19 for discharge into the formation 11.

In the thermal process in accordance with this invention, water is introduced through the inlet water line 22 from a pump 23, for discharge into the rock formation 11.

Initially, air is introduced through the pipe 19 into the oil-bearing zone 11, and the ignitor 17 is energized through the lead 18 to commence ignition of the petroleum within the formation 11 adjacent the injection well 14. An initial flame front 25, in the early period of the process, is illustrated by the dashed lines in FIG. 1.

During the early stages of combustion, such as that illustrated by the flame front 25, water may be introduced in addition to the air, provided the amount and rate of the water volume is not great enough to quench the combustion.

In the initial stages of the recovery process, combustion continues to propagate the flame front 25 forward toward the production well 15. If no water is introduced at this stage, then the process functions in the same manner as the conventional forward combustion process, producing a hot zone 21' upstream of the flame front 25, in the order of 800°-1500° F., with lower temperatures (250°-500° F.) being created immediately downstream of the flame front 25, sufficient to warm and reduce the viscosity of the low-density petroleum within the oil-bearing rock, but not sufficient to produce the desired significant cracking of the petroleum products. Thus, the heated oil of lower viscosity, propelled by the pressurized air, produces movement of the oil within the tar sands formation 11 toward the right of FIG. 1, toward the production well 15, for collection.

If water is also introduced into the early stages of combustion, it is converted to steam by the hot rock in zone 21' so that the process then functions in the same manner as a conventional wet combustion process. The steam, as well as the air, propagated through the flame front creates a longer extending steam zone downstream of the flame front for lowering the viscosity of substantially greater quantities of petroleum, and also for moving the fluid petroleum toward the production well 15.

The liquids and gases accumulating at the production well 15, of conventional construction, may be elevated by a gas lift to a separator, not shown, at the top of the production well 15, in a conventional manner. The separated gases are then discharged through the outlet conduit 27, and the separated liquids, such as oil and water, are discharged through the outlet conduit 28.

In a conventional wet combustion process, usually the only fuel required for the combustion is the oil or hydro-carbon products within the formation 11. When the oil insitu is ignited and supplied with air from the surface, combustion occurs producing a hot flue gas and a combustion or flame front 25, which moves forwardly to a position such as the solid-line position of the front 30 disclosed in FIG. 1. Some cracking of the hydro-carbons may occur in a narrow zone 31 in and just downstream of the flame front 30 and may create carbon deposits in zone 31.

As the flame front 30 advances through the oil reservoir or rock formation 11, the total heat carrying capacity of the flue gases and the water or steam is normally less than the heat carrying capacity of the portion of the rock formation 11 through which the zone 30 passes. Considering the motion of the flame front 30 relative to the rock formation 11 through which the front passes, it may be said that the rock is "incoming rock" since it is moving upstream relative to the flame front 30. As the incoming rock of greater heat carrying capacity encounters the flame front 30, the rock is able to absorb all of the heat generated by the flue gases and the steam at the flame front 30, and therefore, the temperature of the rock formation downstream of the flame front 30 is relatively constant at approximately steam condensation temperature (250°–500° F.).

The term "heat carrying capacity" means the amount of heat capable of being absorbed or generated by the gas mixture or the rock formation per unit of time in BTU's per hour degree Fahrenheit.

It is the purpose of the method of thermal recovery carried out in accordance with this invention to cyclically increase the heat carrying capacity of the flue gases and the steam to a value substantially exceeding the heat carrying capacity of the "incoming rock" formation at the flame front 30. Accordingly, the air/flue gas/steam mixture, rather than being cooled by the "incoming rock", will leave the flame zone at a temperature substantially above the temperature at which the mixture entered the flame zone. This very hot mixture then heats the rock in a "downstream hot zone" in advance of the flame front 30 to a higher temperature range (e.g. 1000°–2000° F.). The heat generated by the combustion at the flame front 30 must be sufficient to increase the temperature in the "downstream hot zone" 32 at least to a cracking temperature of some of the hydrocarbons within the "downstream hot zone" 32. In this manner, the viscous hydrocarbon products within the "downstream hot zone" 32 will be cracked to create hydrocarbon products to facilitate their flow toward the production well 15 by the forwardly moving fluid oil of lesser temperature than that in the "downstream hot zone" 32.

The process carried out in accordance with this invention may be initiated in the same manner as a conventional wet combustion process. In Stage 1 of the process, oil in the formation 11 immediately adjacent the injection well 14 is ignited by energization of the ignitor 17, and air is simultaneously introduced through the line 19 to support the combustion.

In the initial stage of combustion, such as in the generation of the hot zone 21' upstream of the initial flame front 25, a low ratio of water-to-air may be injected into the hot zone 21 through the line 22, if desired. However, the amount and rate of the injection of water must be small enough not to quench the combustion in the flame front.

The combustion process of Stage 1 is continued by the continued introduction of air into the formation 11 with a relatively low ratio of water-to-air.

During Stage 1, the temperature within the combustion zone 21 behind the flame front 30, is raised to approximately 800°–1500° F., for example approximately 1000° F. During this initial combustion process, the flue gases and steam will penetrate the frame front 30 and advance ahead of the flame front 30, but because the total heat carrying capacity of the flue gases and the steam is less than the heat carrying capacity of the "incoming rock" the temperature downstream of the flame front 30 will remain at the condensation temperature of the steam, approximately 250°–500° F. Stage 1 of the process described thus far is substantially the same as in the wet combustion process.

After a relatively large hot zone 21 has developed behind the flame front 30 at a temperature of approximately 1000° F., then Stage 2 of the process is commenced by introducing a substantially greater amount of water through the pipe 22 into the formation 11. One example of the timing of the introduction of the increased amount of water may be the development of a hot zone 21 in which the flame front 30 has advanced approximately 20–25% of the distance L between the injection well 14 and the production well 15. In any event, the timing of the injection of the greater amount or volume rate of water into the formation 11 should occur when there is a substantial mass of hot rock, the heat from which can be transferred to the large amounts of water, not only to convert the water into steam, but to create super-heated steam at approximately the flame temperature, e.g. 1000° F.

In Stage 2, the water rate, or water-to-air ratio is increased sufficiently that the total heat carrying capacity of both the flue gases and the steam is substantially greater than the heat carrying capcaity of the "incoming rock" relatively moving upstream through the flame front 30, so that the "incoming rock" is unable to absorb the sensible heat of the gases and the heat of combustion. Accordingly, the gases leave the flame front at a temperature (for example, 1100°–1800° F.), sufficiently great that they absorb the heat of combustion and can heat the incoming rock to this higher temperature in a separate hot front which forms downstream of the flame front 30 thereby forming a downstream hot zone 32 at cracking temperatures usually in excess of 1000° F., such as 1100°–1800° F.

The injection of the larger amounts of water is continued over a period of time, such as 30 days in a process anticipated to be completed in 1–2 years. After this initial period of injection of the greater amount of water, which is determined by the time when the amount of water may be so excessive that combustion will be quenched, then the operation is returned to Stage 1, in which the water supply to the zone 21 is dropped to a lower amount and/or a lower rate, appropriate to continually sustain the combustion without quenching. Zone 32 downstream of flamefront 30 reverts to a temperature approximately equal to the steam condensation temperature (at 250–500 degrees F.), and the downstream hot zone (at 1000+degrees F.) previously located in zone 32 moves to zone 33. This period of a reduced water supply may continue for approximately 30 days. Then Stage 2 of the operation is resumed and the water supply is again increased to its original greater volume and/or rate into the formationll for another period of, for example, 30 days, until this high level of water supply threatens to quench the combustion within the zone 21. Accordingly, the water volume and/or rate are again reduced to the previous low water volume and rate of Stage 1. The alternate increase and reduction in the water supply of Stages 1 and 2 is continued at substantially regular intervals, such as the 30-day intervals previously described, until essentially all the recoverable oil has been produced or until the desired amount of cracking has been achieved.

The introduction of water is cyclic and varied at periodic intervals over the life of the process. The heating of the reservoir within the "downstream hot zone" 32 to high temperatures occurs as a series of hot zones moving in advance of the flame front 30 and provides a substantially continuous cracking of the oil to produce lower density products of less intrinsic viscosity.

The amount of cracking and viscosity reduction which occurs in the "downstream hot zone" 32 is a function of the temperature in this zone. This temperature is a function of the temperature of the air/steam mixture entering the flame zone 30 and determined by the heat balance in the prior Stage 1 cycle as well as the water-to-air ratio in the Stage 2 cycle. The higher the inlet temperature of the gas/steam mixture entering the flame zone 30, the higher will be the "downstream hot zone" temperature. The greater the water-to-air ratio in the Stage 2 operation, the smaller will be the temperature rise above the inlet temperature to the flame zone 30, and therefore the lower the temperature of the "downstream hot zone" 32. Also, the higher the water-to-air ratio in the Stage 2 operation, the shorter the elapsed time before the Stage 1 operation must be resumed to avoid quenching. In this invention, the temperature level in the "downstream hot zone" 32, is controlled by varying the water-to-air ratio in the Stage 1 operation or in the Stage 2 operation, or both.

Accordingly, this process is particularly useful for more efficiently extracting hydrocarbon products of great density and intrinsic viscosity, such as heavy crude oil, from rock formations, such as the tar sand formation 11, or from oil shales, from which recovery has been poor or uneconomic when carried out with previously known thermal recovery processes.

The cracking of the oil (or kerogen, in the case of oil shale) achieved by this invention has many advantages. The reduction of oil viscosity greatly facilitates the displacement process, and results in an oil product which has a higher value. Some gas may also be generated by the cracking which helps drive the oil from the formation. All these factors allow the economic production of oil, using this invention, from reservoirs, or in situations where otherwise such procedures would not have been possible.

What is claimed is:

1. In the process for the recovery of petroliferous products from a subterranean formation containing said products by insitu wet combustion, the improvement comprising first, initiating the conventional wet combustion process in the usual manner by injecting an oxygen containing stream into said formation through an injection well, obtaining ignition of the petroliferous material in the formation by use of an igniter or other means, initiating the addition of liquid water to said oxygen containing stream being injected into said formation through said injection well, and collecting the gases produced and liquid products from one or more surrounding production wells, and then:

(a) introducing, after combustion has been initiated, in a first stage operation into said formation upstream of the flame front an initial amount of fluids containing oxygen in which the concentration of free uncombined molecular oxygen is controlled, by adjusting the amount of said liquid water stream added to said oxygen containing stream, to be sufficiently high that the flame is not quenched below its ignition temperature and a significant hot zone is established upstream of the flame front having a desired operating temperature range, and (b) subsequently, in a second stage operation, introducing in said formation upstream of said flame front fluids containing free uncombined molecular oxygen in which the concentration of free uncombined molecular oxygen is reduced, by adjusting the amount of said liquid water stream added to said oxygen containing stream, to the point such that the total sensible heat carrying capacity of the fluids entering the flame zone exceeds the heat carrying capacity of a first portion of the formation entering the flame zone at the velocity of movement of said flame front, thereby producing a substantial increase in the temperature of a second portion of said formation downstream of said flame front and creating a downstream hot zone downstream of said flame front in which substantial amounts of petroliferous products are cracked.

2. In the process for the recovery of petroliferous products from a subterranean formation containing said products by insitu wet combustion, the improvement comprising first, initiating the conventional wet combustion process in the usual manner by injecting an oxygen containing stream into said formation through an injection well, obtaining ignition of the petroliferous material in the formation by use of an igniter or other means, initiating the addition of steam to said oxygen containing stream being injected into said formation through said injection well, and collecting the gases produced and liquid products from one or more surrounding production wells, and then:

(a) introducing, after combustion has been initiated, in a first stage operation into said formation upstream of the flame front an initial amount of fluids containing oxygen in which the concentration of free uncombined molecular oxygen is controlled, by adjusting the amount of said steam added to said oxygen containing stream, to be sufficiently high that the flame is not quenched below its ignition temperature and a significant hot zone is established upstream of the flame front having a desired operating temperature range, and (b) subsequently, in a second stage operation, introducing in said formation upstream of said flame front fluids containing free uncombined molecular oxygen in which the concentration of free uncombined molecular oxygen is reduced, by adjusting the amount of said steam added to said oxygen containing stream, to the point such that the total sensible heat carrying capacity of the fluids entering the flame zone exceeds the heat carrying capacity of a first portion of the formation extering the flame zone at the velocity of movement of said flame front, thereby producing a substantial increase in the temperature of a second portion of said formation downstream of said flame front and creating a downstream hot zone downstream of said flame front in which substantial amounts of petroliferous products are cracked.

3. The process according to either of claim 1 or claim 2 in which said second stage operation is terminated just prior to quenching the flame behind said flame front.

4. The process according to either of claim 1 or claim 2 further comprising the steps of repeating said first stage operation and said second stage operation alternately, whereby a series of one or more hot zones is created downstream of the flame front.

5. The process according to either of claim 1 or claim 2 in which the formation includes tar sands and the petroliferous products include heavy oil.

6. The process according to either of claim 1 or claim 2 in which said operating temperature range is approximately 800°-1500° F., and the temperature of said second portion of said formation is approximately 900°-2000° F. in said downstream hot zone.

7. The process according to either of claim 1 or claim 2 in which the temperature of said second portion in said downstream hot zone is varied by varying the concentration of free uncombined molecular oxygen in the fluids entering the flame zone in said first stage operation.

8. The process according to either of claim 1 or claim 2 in which the temperature of said second portion in said downstream hot zone is varied by varying the concentration of free uncombined molecular oxygen in the fluids entering the flame zone in said second stage operation.

9. The process according to claim 7 further comprising varying the concentration of free uncombined molecular oxygen in the fluids entering the flame zone in said second stage operation.

10. The process according to claim 4 in which said first and second stage operations are alternated at substantially equal intervals, each of said second stage operations being terminated just prior to quenching said flame.

11. The process according to either of claim 1 or claim 2 in which the formation includes kerogen-bearing oil shale and the petroliferous products include shale oil and shale gas.

12. The process according to either of claim 1 or claim 2 in which said oxygen-containing fluid is air.

13. The process according to either of claim 1 or claim 2 in which said oxygen-containing fluid is oxygen.

14. The process according to either of claim 1 or claim 2 in which said oxygen-containing fluid is oxygen-enriched air.

15. The process according to claim 4 in which said steps of repeating said first stage and second stage operations alternately, produce a predetermined amount of cracking and viscosity reduction of the petroliferous products, and further comprising the step of subsequently applying a conventional recovery process, without combustion, to said subterranean formation.

* * * * *